US006165548A

United States Patent [19]

Ljungberg

[11] Patent Number: 6,165,548

[45] Date of Patent: Dec. 26, 2000

[54] METHOD RELATING TO AFTER-TREATMENT OF PACKAGING MATERIAL

[75] Inventor: Torgny Ljungberg, Strömsbruk, Sweden

[73] Assignee: Holmen AB, Stockholm, Sweden

[21] Appl. No.: 09/202,936

[22] PCT Filed: Jun. 12, 1997

[86] PCT No.: PCT/SE97/01029

§ 371 Date: Apr. 26, 1999

§ 102(e) Date: Apr. 26, 1999

[87] PCT Pub. No.: WO97/49617

PCT Pub. Date: Dec. 31, 1997

[30] Foreign Application Priority Data

Jun. 24, 1996 [SE] Sweden ..... 9602461

[51] Int. Cl.[7] ..... B05D 1/12

[52] U.S. Cl. ..... 427/197; 427/199; 427/202; 427/204

[58] Field of Search ..... 427/197, 199, 427/202, 204; 493/148, 328, 330

[56] References Cited

U.S. PATENT DOCUMENTS 4,946,372 8/1990 Avni ..... 428/325
5,425,972 6/1995 Calvert .
5,603,997 2/1997 Lindgren et al. .

FOREIGN PATENT DOCUMENTS 0 540 075 A1 5/1993 European Pat. Off. .
1-121377 5/1989 Japan .

OTHER PUBLICATIONS

Dialog Information Services, File 347, Japio database, Accession No. 03003645, Asahi Chem Ind Co Ltd: "Film for Keeping Freshness of Garden Stuff and Cut Flower"; & JP, A, 01–301245, 891205 Dec. 1989.

Dialog Information Services, File 347, Japio database, Accession No. 03404747, Mitsubishi Alum Co Ltd: "Manufacture of Antibacterial Sheet"; & JP, A, 03–067647, 910322 Mar. 1991.

International Search Report.

*Primary Examiner*—Fred J. Parker
*Attorney, Agent, or Firm*—Sughrue, Mion, Zinn, Macpeak & Seas, PLLC

[57] ABSTRACT

The present invention provides a cost-effective manner of adding hydrophobic zeolite to packaging material for preventing or reducing the transmission of order-influencing and taste-influencing substances to the package contents, wherein a hydrophobic zeolite in powder form is added to the packaging material in conjunction with or immediately after applying printing ink and/or varnish to the packaging material.

17 Claims, No Drawings

METHOD RELATING TO AFTER-TREATMENT OF PACKAGING MATERIAL

TECHNICAL FIELD

The present invention relates to a method pertaining to after-treatment, such as printing and varnishing, of packaging material.

The method can be applied to every known kind of packaging material, such as paperboard, paper and plastic, for instance. The construction and properties of these materials are well known. A wide area of use for the packaging material concerned includes packages for storing foodstuffs in solid or liquid form, including such types of goods as chocolate, candy (sweets) and so on. The packaging material is also used for packaging cigarettes, medicines, perfumes, etc.

BACKGROUND ART

It is earlier known, e.g. from the Swedish published specification 469 080 (9103139-3), to add hydrophobic zeolite to different types of packaging materials, including paper and paperboard. The intention with the addition is to prevent the packaging material from smelling, or to reduce smell to the greatest possible extent and/or to prevent the packaged goods from becoming tainted. For instance, with respect to paperboard packaging materials, it has been feared that the paperboard itself contains ill-smelling and/or ill-tasting substances that are transmitted to the packaged goods, which is why hydrophobic zeolite is added to the paperboard during its manufacture or fabrication. It has also been believed that the added zeolite will block ill-smelling and/or ill-tasting substances that are applied to the paperboard in the after-treatment thereof, for instance when various printing inks are applied to the paper-board.

One drawback with adding the hydrophobic zeolite at the formation of the paperboard, i.e. within the paperboard, or with applying the zeolite in the form of a surface coating on the paperboard is that a large quantity is needed in order to achieve a positive effect. Because hydrophobic zeolite is very expensive, treatment of paperboard with zeolite adds greatly to paperboard manufacturing costs.

In addition, comparatively large quantities of volatile organic compounds in printing inks and other treatment agents are applied when offset printing packaging material, for instance. When the packaging material comprises paperboard of the aforedescribed kind, i.e. paperboard that contains hydrophobic zeolite, problems regarding smell and/or taste still arise, since the zeolite present in the paper-board and forming a part thereof is unable to deal with the large quantities of volatile organic compounds that derive from the printing inks and other treatment agents. In order to satisfy the requirements placed by the final consumers of the paperboard, i.e. the packaging companies, with regard to smell and tainting of the packaged products, it is necessary for the printers, primarily those that use the offset method, to air the printed packaging materials over very long periods of time. This results in high costs and logistic problems on the part of the printers.

DISCLOSURE OF THE INVENTION

Technical Problem

It will be evident from the aforegoing stated that the method hitherto used to apply hydrophobic zeolite to/in packaging materials, such as paperboard for instance, has not been cost-effective. Despite the large and expensive additions of zeolite that are made, the effect achieved has been much too low in some cases.

The Solution

The present invention provides a solution to the aforesaid problem and relates to a method pertaining to the after-treatment, such as printing and varnishing, of packaging material, and is characterized in that at least hydrophobic zeolite is added in powder form to the packaging material in conjunction with or immediately after applying printing ink and/or varnish to the packaging material.

The zeolite used shall have a hydrophobicity that is characterized by a residual butanol content that is lower than 0.6% by weight. The hydrophobicity is determined in accordance with the Residual Butanol Test described in U.K. Patent Specification 2,014.970. According to this the zeolite is activated by heating in air at 300° C. for sixteen hours. Ten parts by weight of the thus activated zeolite are then mixed with a solution consisting of one part by weight 1-butanol and 100 parts by weight water. The resultant slurry is stirred slowly for sixteen hours at 25° C. The residual concentration of 1-butanol in the solution is then determined and given in percent by weight. A low value thus indicates a high degree of hydrophobicity. The residual butanol concentration will preferably lie within the range of from 0.0001 to 0.5% by weight, and it is particularly preferred that the residual butanol concentration will lie within the range of from 0.0002 up to 0.3% by weight.

Any known type of zeolite that fulfils the afore-said hydrophobicity requirement can be used when applying the inventive method. Zeolites that are suitable in this context are described in detail in Swedish published specification 469 080 (9103139-3).

According to the present invention, an addition of solely hydrophobic zeolite is fully sufficient. However, hydrophobic zeolite may be mixed in powder form with other powder substances or chemicals, for instance clay and/or starch. Many different types of clay are available, one of which is Kaolin. The starch used may also have different origins and varying forms.

It has been found advantageous if the additive substances have a mean particle size smaller than 60 $\mu$m (microns) and preferably larger than 10 $\mu$m (microns).

It is possible to add the additive substance (the zeolite) or the additive substances together with the inks when printing the material and together with the varnish when varnishing the material, although it is absolutely preferred to add the substance or substances precisely after having applied the ink and/or the varnish to the packaging material, for instance paperboard. Offset printing machines already include a unit for applying spray powder in precisely this position. Spray powder is applied to the printed material when large quantities of ink are applied and it is feared that the ink surfaces will release ink during continued handling of the material. In those instances when spray powder is applied to the packaging material, the additive substance or substances may also be applied together with the spray powder. When spray powder is not applied, the additive substance or substances is/are applied on their own. It is possible to provide an offset printing machine with an additional unit for applying the additive substance or substances, even though it is preferred to uitilize equipment that already exists. Such a unit or a similar unit shall be installed on types of printing machines that do not include a spray powder unit.

Although the inventive method can be applied with all types of packaging materials, it is particularly beneficial with regard to packaging materials that are based on pulp fibres, and then primarily paperboard. The inventive method is extremely useful with respect to paper packaging materials that are subjected to printing and/or varnishing.

Advantages

Because the hydrophobic zeolite is applied to the packaging material where it is needed, i.e. in direct contact with the ink or varnish, the amount in which it is applied can be adapted to the requirement and therewith be minimized, so that the cost of the addition is kept down. It has also been found that the application of the zeolite powder functions well physically while using spray powder units that are already installed on printing machines.

Preferred Embodiment

The inventive method will now be described in more detail and finally follows a working example.

The inventive method can be applied with all printing and varnishing methods for packaging material, e.g. paperboard. Examples of printing methods other than offset printing are screen printing and gravure printing. The chemical compounds included in the printing inks and troublesome from the aspect of smell and taste are organic compounds, preferably carbonyl compounds, alcohols and aromatic hydrocarbons. It is normal to apply four different coloured inks to the packaging material in offset printing, wherein the inks are applied with the aid of mutually sequential rolls.

In some cases, the after-treatment of the packaging material is ceased after having applied these inks where intended. In other cases, the printing machine or printing press may include a fifth roll which applies some form of varnish to the packaging material. The varnish applicator need not be built-into the printing press or constructed together therewith, but may instead be free standing. In some cases, no print and no printing inks are applied to the packaging material, but solely varnish.

There are two main types of varnish, one which is very similar to the described inks but containing no pigments, and one other type of varnish, which is dried with ultraviolet light and is accordingly referred to as UV varnish.

The first mentioned type of varnish contains the same type of troublesome substances as the related inks, whereas the troublesome content of the UV varnish is mainly comprised of aromatic carbonyl compounds.

As before mentioned, hydrophobic zeolite can be added in a pure state, i.e. in the powder state in which it exists. In order to improve the physical properties of the zeolite powder and therewith facilitate spreading of the powder on the packaging material, it is beneficial to treat the zeolite with clay for instance, such as to form aggregates of these substances. The admixture of starch is also beneficial. However, this results in a reduction in the capacity to bind or take up volatile ill-smelling substances per unit of weight. The particle size or grain size that provides an optimal effect will be determined empirically. The admixture and treatment of zeolite with clay or starch results in aggregates of these substances and in an increased particle size. An increased particle size reduces the problem associated with possible dusting of the product.

EXAMPLE 1

A test was carried out in accordance with the invention (plus a reference test) on a packaging material in the form of a paperboard designated Invercote®G having a grammage of 240 g/m$^2$ and a sheet size of 700×1000 mm. The paperboard was printed in an offset printing press under the following conditions:

| | |
|---|---|
| Printing press = | Roland Rekord with 4-colour ink stations and RCT seini-automatic ink control |
| Inks = | From the company Sun Chemical of the type Grafo Sun Echo Lith<br>Europa black 24 - 76700<br>Europa blue 24 - 46700<br>Europa red 24 - 36700<br>Europa yellow 24 - 26700 |
| Ink sequence = | Black, Cyan, Magenta, Yellow |
| Density = (target value) | B = 1.80, C = 1.40, M = 1.35, Y (Yellow) = 1.35 |
| Moisture water = | From the company Sun Chemical<br>3% of type Grafo Stabilat R 06-04300<br>10% IPA<br>pH = 4.8–5.0 |
| Rubber cloth = | Explorer (supplied by Bergvalls Grafiska AB) |
| Printing plate = | Polychrome of type Vistar 360 |
| Speed = | 6000 sheets/hour |
| Relative humidity = | 53% |
| Temperature = | 20° C. |

The printing press included a spray powder unit that was used to apply a powder mixture of Kaolin clay and hydrophobic zeolite of type BMH supplied by the company Akzo Nobel AB. The zeolite itself had an hydrophobicity of less than 0.6% by weight in residual butanol concentration. The added amount of said mixture was 0.2 g and 0.5 g respectively per m$^2$ of the paperboard. The mean grain size was 50 $\mu$m (microns) and the activity concentration with respect to zeolite was only 35%. No additive substance was applied via the spray powder unit during a part of the printing process and the thus untreated portion of paperboard was used as a reference sample.

Since the chemicals were applied to the paperboard through the medium of the spray powder unit, they will have been applied immediately after having applied the printing inks to the paperboard.

The finished paperboard was subjected to a residual flavour test in accordance with VTT Standard 431787 taken from Biotechnology and Food Research Institute in Finland (the Robinson test).

The following results were obtained:

TABLE 1

| Addition of hydrophobic zeolite Amount in gram/m$^2$ | Robinson test Mean value |
|---|---|
| 0 | 2.7 |
| 0.2 | 2.2 |
| 0.5 | 2.3 |

With regard to this test applies that the lower the numerical value the less residual flavour. As will be evident from the table, the addition of the additives had a clear effect and that an increase in the amount of the additives from 0.2 gram/m$^2$ to 0.5 gram/m$^2$ gave no improvement.

An additive quantity of 0.2 gram/m$^2$ paperboard is very low. More specifically, or the order of 10% of the amount that is normally applied when admixing hydrophobic zeolite in paperboard, i.e. in the actual manufacture of the paperboard, with the intention of also dealing with ill-smelling and ill-tasting substances in the after-treatment of the paperboard.

Running of the printing press was not impaired when adding the chemicals during the after-treatment of paperboard.

Judging from the printing result, it would probably be beneficial to reduce the grain size of the additive, i.e. to a grain size smaller than 50 μm.

What is claimed is:

1. A method relating to printing and varnishing after-treatment of packaging material, comprising separately adding at least hydrophobic zeolite in powder form to the packaging material in conjunction with or immediately after applying printing ink and/or varnish to the packaging material, resulting in zeolite powder on the surface of the printing ink and/or varnish.

2. A method according to claim 1, wherein the zeolite additive substance has a hydrophobicity that is characterized by a residual butanol concentration of less than 0.6% by weight.

3. A method according to claim 1 or 2, wherein the hydrophobic zeolite is mixed with clay and/or starch in powder form as a further additive substance.

4. A method according to claims 1 or 2, characterized in that the additive substance or substances has/have a mean particle size smaller than 60 μm (microns).

5. A method according to claims 1 or 2, characterized by applying the additive substance or substances to the packaging material by means of a spray powder unit.

6. A method according to claims 1 or 2, characterized by applying the additive substance or substances to the packaging material by means of an extra spray powder unit.

7. A method according to claim 1 or 2; characterized by applying the additive substance or substances to the packaging material in conjunction with or immediately after printing the packaging material using an offset printing process.

8. A method according to claims 1 or 2, wherein the packaging material is based on pulp fibres.

9. A method according to claim 3, wherein the additive substance or substances has/have a mean particle size smaller than 60 μm (microns).

10. A method according to claim 3, comprising applying the additive substance or substances to the packaging material by means of a spray powder unit.

11. A method according to claim 3, comprising applying the additive substance or substances to the packaging material by means of an extra spray powder unit.

12. A method according to claim 3, comprising applying the additive substance or substances to the packaging material in conjunction with or immediately after subjecting the packaging material to an offset printing process.

13. A method according to claim 3, wherein the packaging material is based on pulp fibres.

14. A method according to claim 4, comprising applying the additive substance or substances to the packaging material by means of a spray powder unit.

15. A method according to claim 4, comprising applying the additive substance or substances to the packaging material by means of an extra spray powder.

16. A method according to claim 4, comprising applying the additive substance or substances to the packaging material in conjunction with or immediately after subjecting the packaging material to an offset printing process.

17. A method according to claim 4, wherein the packaging material is based on pulp fibres.

* * * * *